US008690095B2

(12) United States Patent
Kim

(10) Patent No.: US 8,690,095 B2
(45) Date of Patent: Apr. 8, 2014

(54) BOBBIN FIXING APPARATUS

(75) Inventor: Jun-Ho Kim, Daegu (KR)

(73) Assignee: JVM Co., Ltd. (KR)

( * ) Notice: Subject to any disclaimer, the term of this patent is extended or adjusted under 35 U.S.C. 154(b) by 495 days.

(21) Appl. No.: 13/073,009

(22) Filed: Mar. 28, 2011

(65) Prior Publication Data

US 2012/0211585 A1 Aug. 23, 2012

(30) Foreign Application Priority Data

Feb. 18, 2011 (KR) ..... 10-2011-0014710

(51) Int. Cl.

| | |
|---|---|
| ***B65H 18/04*** | (2006.01) |
| ***B65H 16/04*** | (2006.01) |
| ***B65H 75/28*** | (2006.01) |
| ***B65H 75/18*** | (2006.01) |

(52) U.S. Cl.
USPC ..... 242/532.5; 242/586; 242/597.3

(58) Field of Classification Search
CPC ..... B65H 16/04; B65H 18/026; B65H 49/36; B65H 75/245; B65H 75/28; B65H 75/285; B65H 2301/41335; B65H 2402/64
USPC ..... 242/532, 532.5, 579, 586–586.6, 597, 242/597.1, 597.2, 597.3, 597.5, 613, 614
See application file for complete search history.

(56) References Cited

U.S. PATENT DOCUMENTS

| | | | | |
|---|---|---|---|---|
| 927,604 | A * | 7/1909 | Seib | 242/586.6 |
| 3,033,483 | A * | 5/1962 | Keesling | 242/586.6 |
| 3,782,264 | A * | 1/1974 | Masygan | 242/602.1 |
| 4,157,793 | A * | 6/1979 | Lucia | 242/483.7 |

* cited by examiner

*Primary Examiner* — William E Dondero
(74) *Attorney, Agent, or Firm* — Cantor Colburn LLP

(57) ABSTRACT

Disclosed is a bobbin fixing apparatus. The bobbin fixing apparatus includes a rotating shaft installed to a mounting plate and provided with a fixing unit partially protruding from the rotating shaft so as to be inserted into the rotating shaft, and a bobbin on or from which an object is wound or unwound, the bobbin being placed on the rotating shaft such that the fixing unit is exposed in front of the bobbin. The bobbin includes a rotating body, a plurality of bobbin members on which an object is wound, and an end coupler configured to be operated upon receiving pressure when the bobbin is placed on the rotating shaft, the end coupling serving to keep an end of the object in a fixed position on the rotating shaft during winding or to release the end of the object from the fixed position during unwinding.

8 Claims, 11 Drawing Sheets

BOBBIN FIXING APPARATUS

BACKGROUND OF THE INVENTION

1. Field of the Invention

The present invention relates to a bobbin fixing apparatus, and more particularly, to a bobbin fixing apparatus in which a bobbin is placed on a rotating shaft to ensure simplified coupling/separation and normal rotation thereof regardless of a direction in which the bobbin is placed on the rotating shaft, and an end of an object to be wound on or unwound from the bobbin can be kept in a fixed position or released from the fixed position when the bobbin is placed on the rotating shaft, resulting in increased fixing convenience.

2. Description of the Related Art

In general, a bobbin is a device around which an extremely long slender object is wound for storage or unwound for use. The bobbin is secured to a rotating shaft such that the object is wound on or unwound from the bobbin via rotation of the bobbin.

Referring to FIG. 7, a conventional bobbin fixing apparatus includes a rotating shaft 2 rotatably installed to a mounting plate 5 such that a bobbin B is placed on the rotating shaft 2.

The conventional bobbin fixing apparatus is provided at an end of the rotating shaft 2 with a detent 1 to prevent separation of the bobbin B placed on the rotating shaft 2. To this end, the detent 1 is adapted to be rotated when the bobbin B is placed on the rotating shaft 2. In addition, an elastic spring (not shown) and a horizontally movable stopper (not shown) are accommodated in the rotating shaft 2, and a lower end of a hinge 3 is connected to a central position of the rotating shaft 2.

A detent insertion recess 7 is indented in an outer surface of the bobbin B. When the detent 1 is rotated, a part of the detent 1 is inserted into the detent insertion recess 7 to allow the bobbin B to be secured to the rotating shaft 2.

With the use of the bobbin fixing apparatus having the above described configuration, if the bobbin B is placed on the rotating shaft 2, the hinge 3 comes into contact with an inner surface of the bobbin B and is pushed into the rotating shaft 2 upon receiving pressure applied by the bobbin B. In this case, the stopper and the elastic spring assist in pushing the hinge 3 into the rotating shaft 2, thereby causing the detent 1 to be rotated and inserted into the detent insertion recess 7 in linkage with movement of the hinge 3. As such, the bobbin B is secured to the rotating shaft 2.

Additionally, referring to FIG. 8, a coupling member 9*a*, by which an end of an object to be wound is caught, is installed on the bobbin B. A rotatable member 9*b* is rotatably seated on an upper surface of the coupling member 9*a* using an elastic torsion member (not shown) to keep the end of the object in a fixed position.

To keep the end of the object in a fixed position prior to winding the object on the bobbin B, it is necessary for an operator to press one side of the rotatable member 9*b* so as to lift the rotatable member 9*b*. Then, as the user releases the rotatable member 9*b* after putting the end of the object into the coupling member 9*a*, the end of the object is kept in a fixed position.

In the case of the above described conventional bobbin fixing apparatus, however, since the detent 1 is rotated and inserted into the detent insertion recess 7 to secure the bobbin B to the rotating shaft 2 when the bobbin B is placed on the rotating shaft 2, replacement of the bobbin B is troublesome because it is necessary to forcibly rotate the detent 1 inserted in the detent insertion recess 7 in order to separate the bobbin B from the rotating shaft 2.

In particular, although the bobbin B may act to push the hinge 3 thus causing rotation of the detent 1 even if the bobbin B is incorrectly placed, the detent 1 may fail to accurately secure the incorrectly positioned bobbin B.

If the rotating shaft 2 is rotated in a state in which the bobbin B is not accurately secured, the bobbin B may be unintentionally separated from the rotating shaft 2 during rotation of the rotating shaft 2, which may stop a current operation and cause damage to a device, to which the bobbin B is installed, or damage to an object wound on the bobbin B.

In addition, since putting or taking the end of the object into or from the coupling member 9*a* requires for the operator to press the rotatable member 9*b*, unwinding the object from the bobbin B requires a troublesome process in that the operator must temporarily stop an unwinding operation to press the rotatable member 9*b* and then, restart the unwinding operation after taking the end of the object from the coupling member 9*a*.

In particular, if the rotating shaft 2 is rotated before the end of the object wound on the bobbin B is not yet released from the fixed position, this may cause damage to the object.

SUMMARY OF THE INVENTION

Therefore, the present invention has been made in view of the above problems, and it is an object of the present invention to provide a bobbin fixing apparatus in which a bobbin is simply placed on and is secured to a rotating shaft.

It is another object of the present invention to provide a bobbin fixing apparatus which prevents unwanted separation of a bobbin from a rotating shaft.

It is another object of the present invention to provide a bobbin fixing apparatus in which an end coupler, on which an object is wound, is provided to keep an end of the object in a fixed position or release the end of the object from the fixed position as pressure is applied to one side or the other side of the end coupler.

It is another object of the present invention to provide a bobbin fixing apparatus in which an end of an object wound on a bobbin is kept in a fixed position by attractive force between a movable magnet and a stationary magnet of opposite magnetic polarities.

It is another object of the present invention to provide a bobbin fixing apparatus in which an end of an object wound on a bobbin is released from a fixed position by repulsive force between magnets of like magnetic polarity.

It is another object of the present invention to provide a bobbin fixing apparatus in which a moving pressure member, both ends of which are connected to a pair of rotating bodies of a bobbin, is movable outward from either of the rotating bodies without a risk of separation from the rotating bodies.

It is another object of the present invention to provide a bobbin fixing apparatus in which a magnet, which has been displaced upon receiving pressure, is returned to an original position thereof when the pressure is released.

It is another object of the present invention to provide a bobbin fixing apparatus in which an end of an object wound on a bobbin is kept in a fixed position or is released from the fixed position when the bobbin is placed on a rotating shaft.

It is a further object of the present invention to provide a bobbin fixing apparatus in which a bobbin is secured to a rotating shaft.

In accordance with the present invention, the above and other objects can be accomplished by the provision of a bobbin fixing apparatus including a mounting plate, a rotating shaft installed to a front surface of the mounting plate and provided with a fixing unit partially protruding from the rotating shaft so as to be inserted into the rotating shaft, and a bobbin on or from which an object is wound or unwound, the bobbin being placed on the rotating shaft regardless of a direction in which the bobbin accesses the rotating shaft such that the fixing unit is exposed in front of the bobbin.

The fixing unit may include a recess indented in a front circumferential position of the rotating shaft, and a shaft fixing member inserted in the recess so as to partially protrude from the rotating shaft, the shaft fixing member being completely inserted into the recess while pressing an elastic member provided therebelow upon receiving pressure applied when the bobbin is placed on the rotating shaft.

A through-hole may be perforated in the shaft fixing member to guide the shaft fixing member to be inserted into the recess and be installed within the rotating shaft, and a penetrating member may be inserted in the through-hole such that both ends thereof are accommodated within the shaft fixing member.

The bobbin may include a rotating body consisting of a first rotating body and a second rotating body spaced apart from each other, the first and second rotating bodies respectively having shaft holes for insertion of the rotating shaft, a plurality of bobbin members, on which the object is wound, each bobbin member having one end and the other end respectively connected to the first and second rotating bodies to guide insertion of the rotating shaft into the rotating body, and an end coupler having one end and the other end respectively connected to the first and second rotating bodies to guide insertion of the rotating shaft into the rotating body, the end coupler serving to keep an end of the object in a fixed position or release the end of the object from the fixed position upon receiving pressure applied when the rotating body is placed on the rotating shaft.

The end coupler may include a first coupling member in which a moving pressure member centrally provided with a first magnet is installed, the moving pressure member being configured such that both ends thereof protrude outward from the first and second rotating bodies and being movable toward the first rotating body or the second rotating body, and a second coupling member spaced apart from the first coupling member and internally provided with a second magnet at a position corresponding to the first magnet, both ends of the second coupling member being installed in vertically elongated holes of the first and second rotating bodies so as to be moved toward or away from the first coupling member.

The first magnet and the second magnet may be oppositely charged magnets.

Third magnets may be provided at opposite sides of the first magnet such that a distance between the center of the first magnet and the center of either of the third magnets is equal to a moved distance of the moving pressure member when pressure is applied to the moving pressure member, the third magnets and the second magnet being magnets of like magnetic polarity.

A central portion of the moving pressure member may have a greater outer diameter than an outer diameter of both end portions of the moving pressure member.

An elastic member may be wound on either of the end portions of the moving pressure member to return the moving pressure member to an original position thereof when pressure applied to move the moving pressure member is removed.

The end coupler may further include a pressure ring separably placed on the rotating shaft to press one end of the movable pressure member when the rotating body is placed on the rotating shaft.

A fixing recess may be formed in an outer surface of the bobbin such that one end of the shaft fixing member of the fixing unit is inserted into the fixing recess when the bobbin is placed on the rotating shaft.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, a preferred embodiment of the present invention will be described in more detail with reference to the accompanying drawings.

Figure 1:
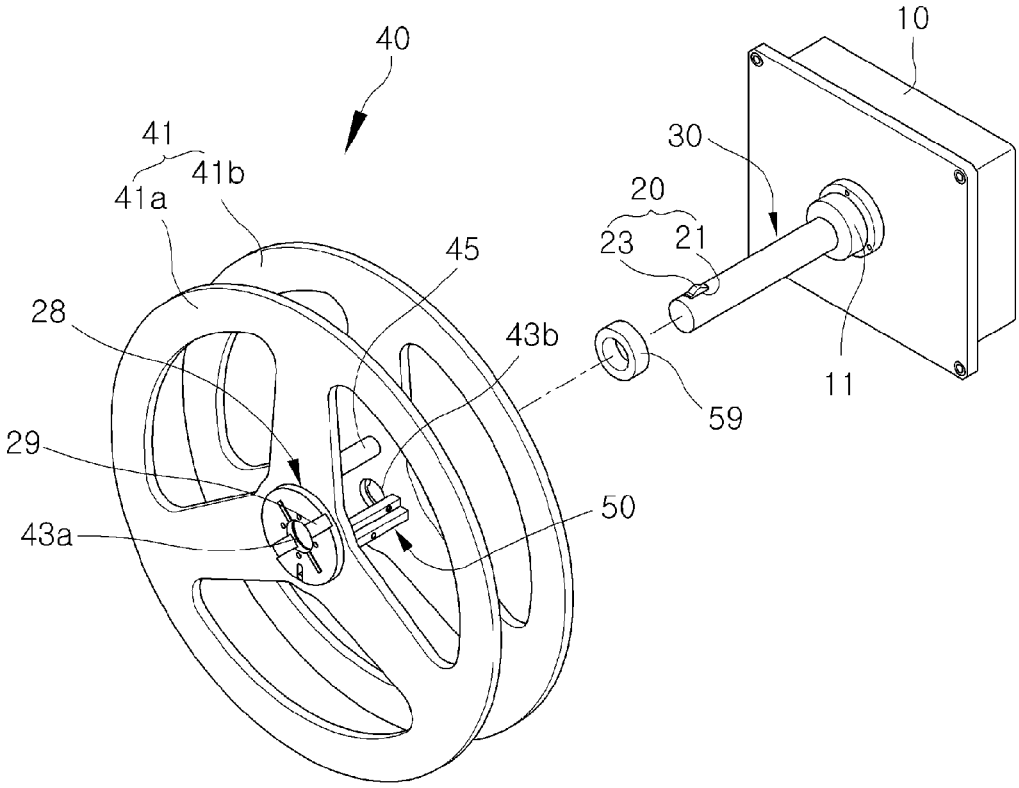
FIG. 1 is a view illustrating a bobbin and a rotating shaft provided in a bobbin fixing apparatus according to the present invention.
Figure 2:
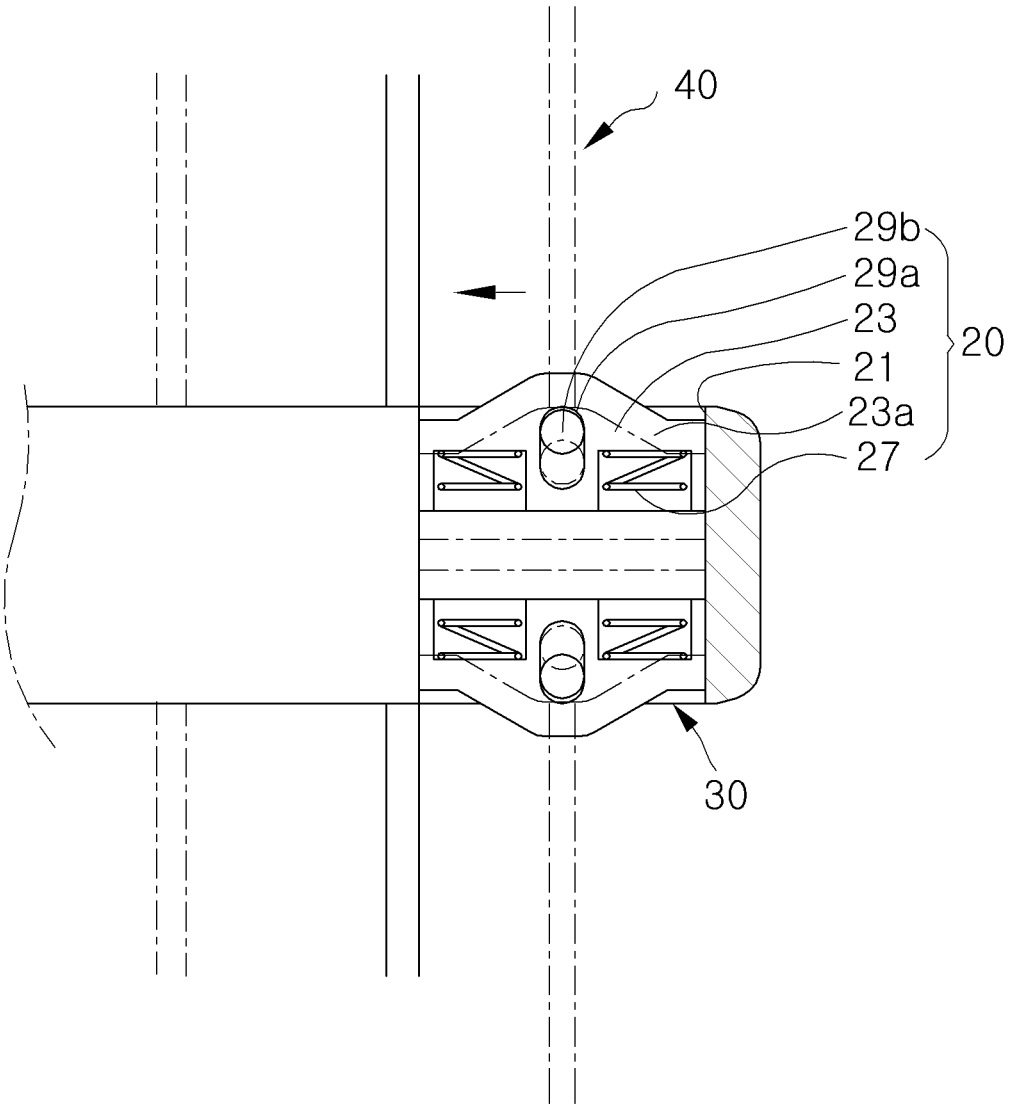
FIG. 2 is a view illustrating the bobbin placed on the rotating shaft of the bobbin fixing apparatus according to the present invention.
Figure 3:
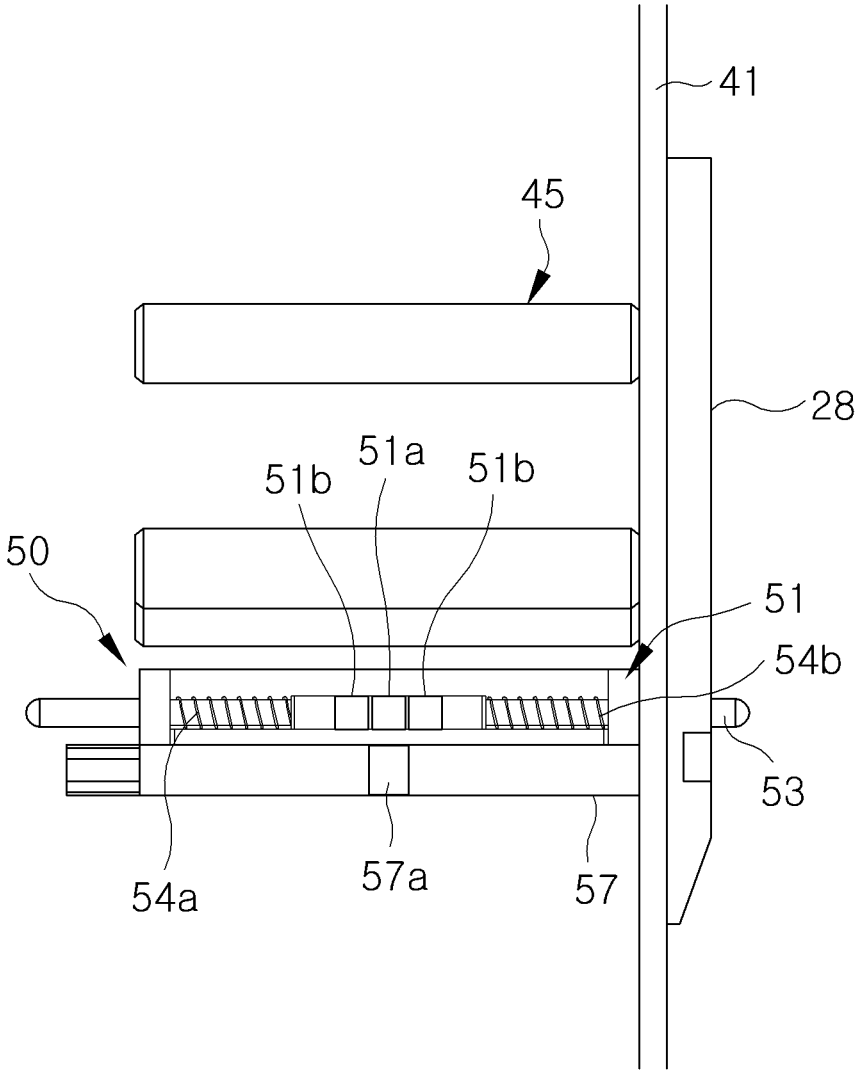
FIG. 3 is a view illustrating an end coupler provided in the bobbin fixing apparatus according to the present invention.

FIG. 1 is a view illustrating a bobbin and a rotating shaft provided in a bobbin fixing apparatus according to the present invention, FIG. 2 is a view illustrating the bobbin placed on the rotating shaft of the bobbin fixing apparatus according to the present invention, and FIG. 3 is a view illustrating an end coupler provided in the bobbin fixing apparatus according to the present invention.

As illustrated, the bobbin fixing apparatus of the present invention includes a mounting plate 10, a rotating shaft 30 mounted to a front surface of the mounting plate 10 and provided with a fixing unit 20 partially protruding from the rotating shaft 30 so as to be inserted into the rotating shaft 30, and a bobbin 40 on which an object is wound, the bobbin 40 being placed on the rotating shaft 30 regardless of a direction in which the bobbin 40 accesses the rotating shaft 30 such that the fixing unit 20 is exposed in front of the bobbin 40.

The mounting plate 10 may be one surface of a device to which the bobbin 40 which will be described in detail hereinafter is installed. The front surface of the mounting plate 10 is provided with a rotating shaft mounting hole 11 into which the rotating shaft 30 which will be described in detail hereinafter is inserted, which enables rotatable installation of the rotating shaft 30.

Here, rotatable installation of the rotating shaft 30 is well known and thus, a detailed description thereof will be omitted herein.

The rotating shaft 30 is installed to the front surface of the mounting plate 10 such that the bobbin 40 which will be described in detail hereinafter is rotatably placed on the rotating shaft 30 such that the object is wound on or unwound from the bobbin 40 via rotation of the bobbin 40. Preferably, the rotating shaft 30 has a cylindrical rod shape.

The fixing unit 20 serves to prevent unwanted separation of the bobbin 40 placed on the rotating shaft 30. In the embodiment, a pair of fixing units 20 may be symmetrically arranged on the rotating shaft 30.

More specifically, the fixing unit 20, as illustrated in FIG. 2, includes a recess 21 indented in a front circumferential position of the rotating shaft 30, a shaft fixing member 23 inserted in the recess 21 so as to protrude from the rotating shaft 30, and an elastic member 27 located underneath the shaft fixing member 23.

The shaft fixing member 23 is perforated with a through-hole 29*a*, which guides the shaft fixing member 23 to be inserted into the recess 21 and be seated within the rotating shaft 30. A penetrating member 29*b* is inserted into the through-hole 29*a* such that both ends thereof are accommodated within the shaft fixing member 23.

Preferably, the shaft fixing member 23 is provided with a slope 23*a* to provide the shaft fixing member 23 with a raised central portion and lowered end portions. This configuration facilitates easy coupling or separation of the bobbin 40 with respect to the rotating shaft 30.

The fixing unit 20 is provided at the front position of the rotating shaft 30 and is located in front of the bobbin 40 placed on the rotating shaft 30.

A support member 28 is attached to an outer surface of the bobbin 40, i.e. an outer surface of a rotating body 41 which will be described hereinafter. The supporting member 28 is provided with a fixing recess 29 such that one end of the shaft fixing member 23 is inserted into the fixing recess 29 of the supporting member 28 once the bobbin 40 is placed on the rotating shaft 30.

With the above described configuration, if the bobbin 40 is placed on the rotating shaft 30, the bobbin 40 applies pressure to the shaft fixing member 23 while moving along the slope 23*a* of the shaft fixing member 23, thereby causing the elastic member 27 located underneath the shaft fixing member 23 to be pressed and allowing the shaft fixing member 23 to be inserted into the recess 21. Then, if the bobbin 40 is completely placed on the rotating shaft 30 and the pressure applied to the shaft fixing member 23 is released, the shaft fixing member 23 is returned to an original position thereof by the elastic member 27 so as to protrude from the rotating shaft 30, thereby supporting the bobbin 40 and preventing the bobbin 40 from being separated from the rotating shaft 30.

Further, as the end of the shaft fixing member 23 is inserted into the fixing recess 29 of the supporting member 28 attached to the rotating body 41 via rotation of the bobbin 40, the bobbin 40 is firmly secured to the rotating shaft 30.

The bobbin 40 includes the rotating body 41, a plurality of bobbin members 45 on which the object is wound, and an end coupler 50. The rotating body 41 consists of a first rotating body 41*a* and a second rotating body 41*b* spaced apart from each other, which are respectively provided with first and second shaft holes 43*a* and 43*b* for insertion of the rotating shaft 30. Each of the bobbin members 45 has one end and the other end connected respectively to the first and second rotating bodies 41*a* and 41*b* to guide the rotating body 41 to be placed on the rotating shaft 30. The end coupler 50 is installed to a lower position of the rotating body 41 in the same manner as the bobbin members 45 and serves to keep an end of the object in a fixed position or release the end of the object from the fixed position.

A distance between the first and second rotating bodies 41*a* and 41*b* of the rotating body 41 must be greater than the width of the object wound on the bobbin 40, to ensure that the object is uniformly wound without interference at both sides thereof with the first and second rotating bodies 41*a* and 41*b*.

The bobbin members 45 are connected at one end and the other end thereof to the first rotating body 41*a* and the second rotating body 42*b* and are arranged to surround the first and second shaft holes 43*a* and 43*b* to allow the object to be wound along an outer circumference of the bobbin members 45.

As the bobbin members 45 are arranged to surround the first and second shaft holes 43*a* and 43*b*, the bobbin members 45 serve to guide insertion of the rotating shaft 30 through the first and second shaft holes 43*a* and 43*b*, which can prevent incorrect insertion of the rotating shaft 30.

The end coupler 50, as illustrated in FIG. 3, is located at the lower position of the rotating body 41 and is connected at both ones thereof to the first and second rotating bodies 41*a* and 41*b* in the same manner as the bobbin members 45. The end coupler 50 is configured not only to allow the object to be wound thereon, but also to keep the end of the object in a fixed position during winding and release the end of the object from the fixed position during unwinding.

More specifically, the end coupler 50 includes a first coupling member 51 kept in a fixed position, and a second coupling member 57 movably located below the first coupling member 51 so as to be spaced apart from the first coupling member 51 by a predetermined distance or to come into contact with the first coupling member 51.

A moving pressure member 53 is installed in the first coupling member 51 and has a sufficient length to allow both ends thereof to protrude outward from the rotating body 41. Thus, if pressure is applied to the moving pressure member 53, the moving pressure member 53 is moved to protrude outward from one side or the other side of the rotating body 41, i.e. from the first rotating body 41*a* or the second rotating body 41*b*.

In this case, both ends of the moving pressure member 53 have a diameter less than that of a central portion of the moving pressure member 53 so as to penetrate the first and second rotating bodies 41*a* and 41*b*. In addition, first and second elastic members 54*a* and 54*b* are wound on opposite portions of the moving pressure member 53. One of the first and second elastic members 54*a* and 54*b* located in the direction in which the moving pressure member 53 is moved may be pressed and then, be returned to an original position thereof.

A first magnet 51*a* is installed at the central portion of the moving pressure member 53, and third magnets 51*b* are installed at opposite sides of the first magnet 51*a*. A distance between the center of the first magnet 51*a* and the center of either of the third magnets 51*b* is equal to a moved distance of the moving pressure member 53 when pressure is applied to the moving pressure member 53. The first magnet 51*a* and the third magnet 51*b* are oppositely charged magnets.

A second magnet 57*a* is installed in a central portion of the second coupling member 57 at a position corresponding to the first magnet 51*a*.

Preferably, the first magnet 51*a* and the second magnet 57*a* are oppositely charged magnets to allow the first coupling member 51 and the second coupling member 57 to come into contact with each other by attractive force between the first magnet 51*a* and the second magnet 57*a*.

Both ends of the second coupling member 57 are inserted into vertically elongated holes 58 of the first and second rotating bodies 41*a* and 41*b*. Thus, the second coupling member 57 may be moved upward to the top of the hole 58 so as to come into contact with the first coupling member 51, or may be moved downward so as to be spaced apart from the first coupling member 51.

Figure 4A:
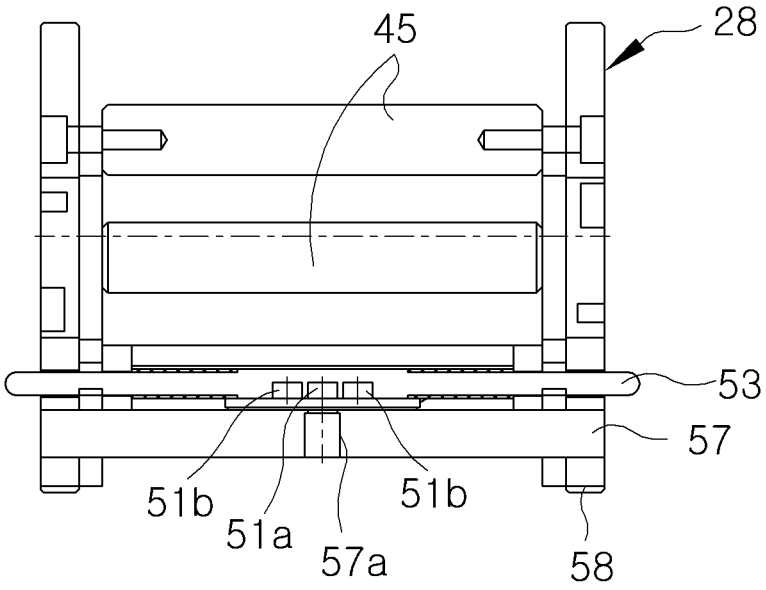
FIGS. 4A and 4B are views illustrating operation of keeping an end of an object in a fixed position using the end coupler according to the present invention.
Figure 4B:
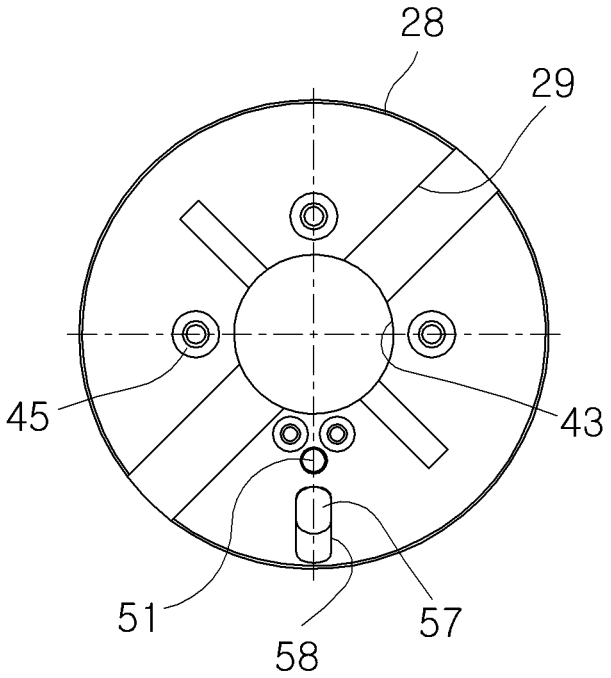
Figure 5A:
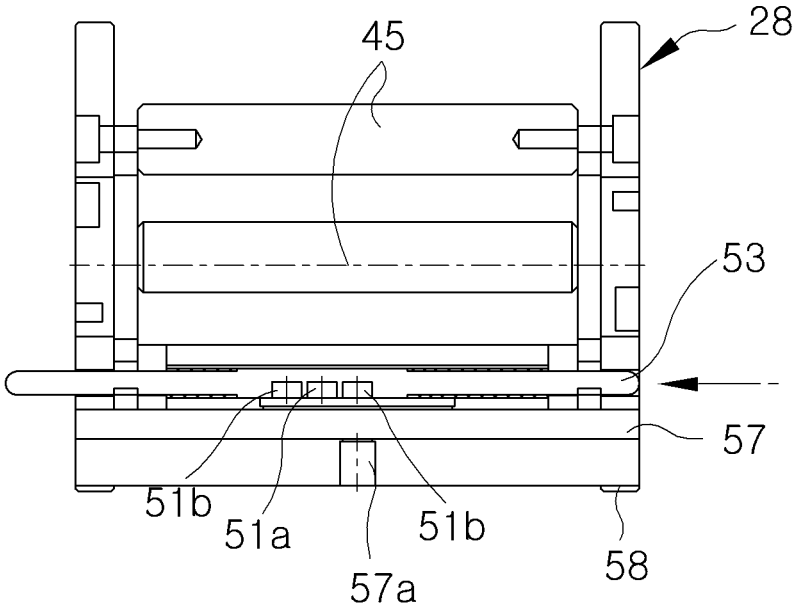
FIGS. 5A, 5B and 5C are views illustrating operation of releasing the end of the object from the fixed position using the end coupler according to the present invention.
Figure 5B:
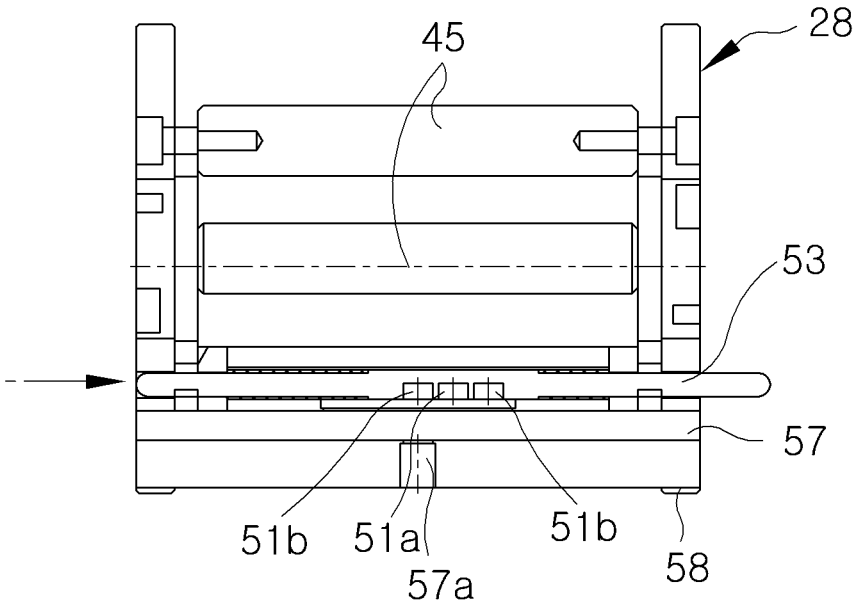
Figure 5C:
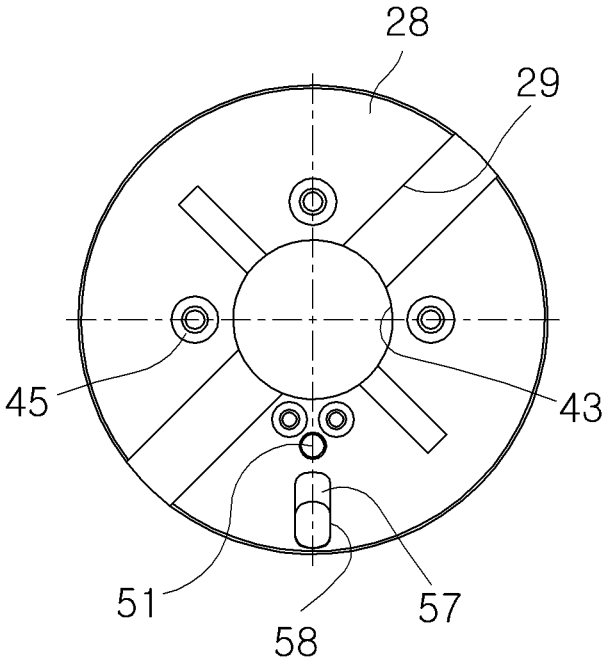
Figure 6:
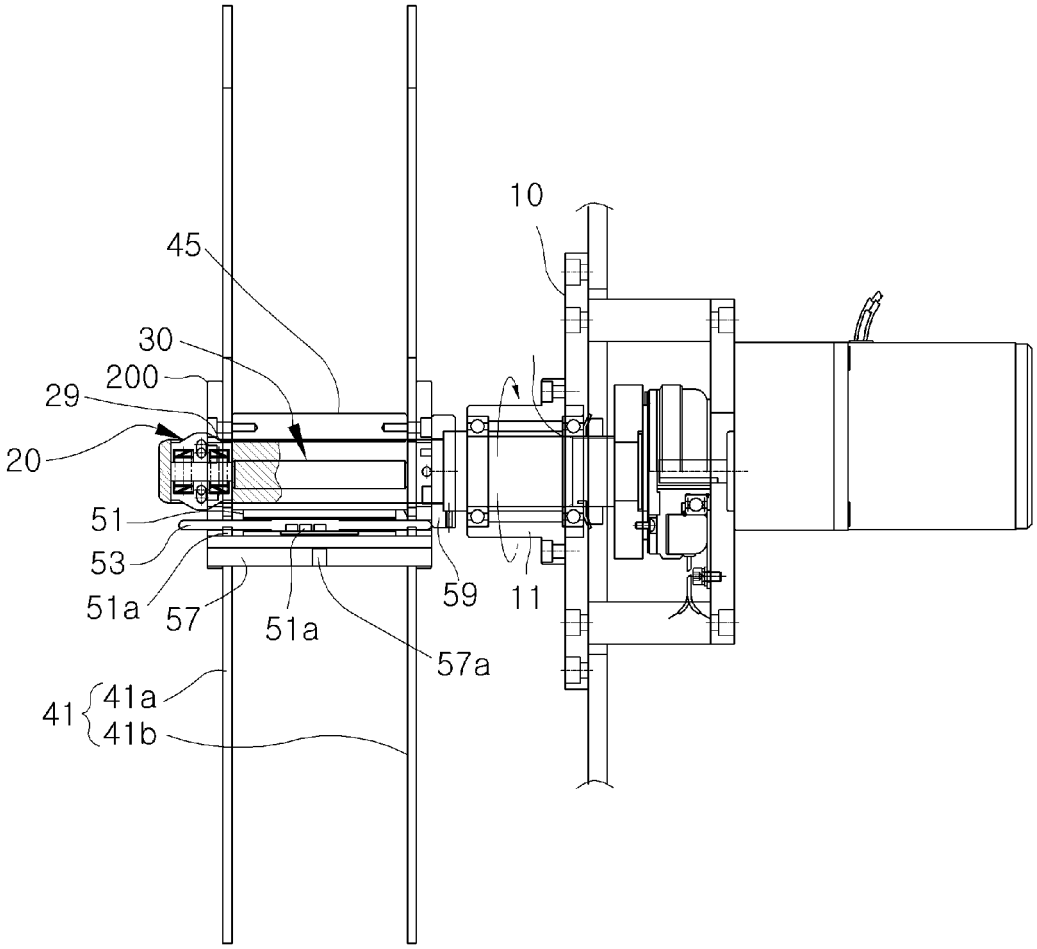
FIG. 6 is a side view illustrating a pressure ring provided in the bobbin fixing apparatus according to the present invention.
Figure 7:
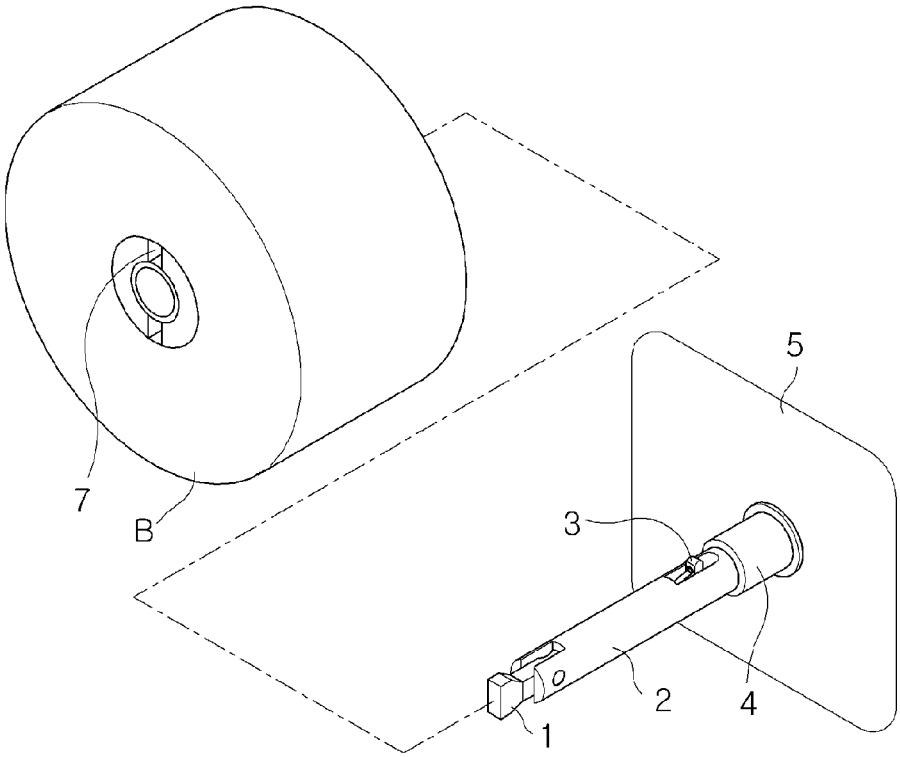
Fig. 7 PRIOR ART
FIG. 7 is a view illustrating a conventional rotating shaft and a bobbin.
Figure 8:
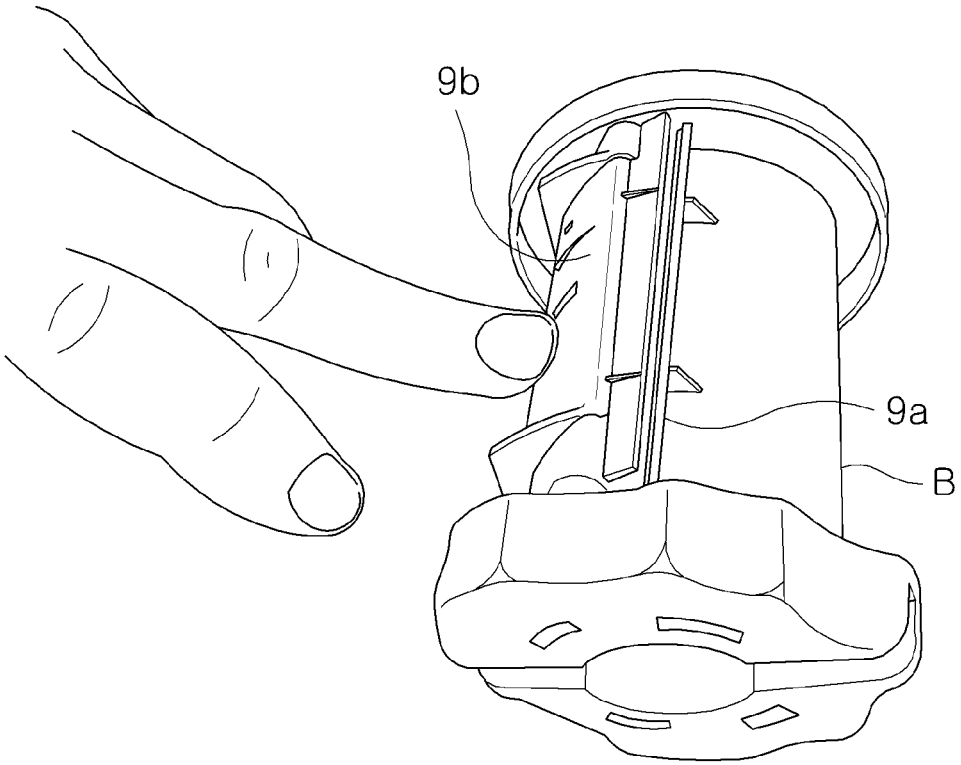
Fig. 8 PRIOR ART
FIG. 8 is a view illustrating operation of a conventional end coupling member.

FIGS. 4A and 4B are views illustrating operation of keeping the end of the object in a fixed position using the end coupler according to the present invention, FIGS. 5A, 5B and 5C are views illustrating operation of releasing the end of the object from the fixed position using the end coupler according to the present invention, and FIG. 6 is a side view illustrating a pressure ring provided in the bobbin fixing apparatus according to the present invention.

Referring to FIGS. 4A and 4B, it is necessary to keep the end of the object in a fixed position during winding to ensure stable winding of the object on the bobbin 40. To this end, the first magnet 51*a* is provided in the central portion of the first coupling member 51 and the second magnet 57*a* is provided in the central portion of the second coupling member 57 such that the second coupling member 57 below the first coupling member 51 is moved upward along the vertically elongated hole 58 so as to come into contact with the first coupling member 51 by attractive force between the first and second magnets 51*a* and 57*a* of opposite magnetic polarities in a state in which pressure is not applied to the moving pressure member 53.

In this way, the end of the object located between the first and second coupling members 51 and 57 is kept in a fixed position.

On the other hand, referring to FIGS. 5A and 5B, it is necessary to release the end of the object from the fixed position during unwinding in order to prevent the end of the object from being damaged by tension. To this end, it is necessary to create a predetermined gap between the first coupling member 51 and the second coupling member 57.

If pressure is applied to one end or the other end of the moving pressure member 53 by the operator so as to move the moving pressure member 53, the first magnet 51*a* is moved in the direction in which the moving pressure member 53 is moved, which causes the first magnet 51*a* and the second magnet 57*a* of the second coupling member 57 to be separated from each other to an extent that magnetic attraction therebetween is no longer a factor.

Then, as illustrated in FIG. 5C, as the third magnet 51*b* is located to correspond to the second magnet 57*a* of the second coupling member 57, the second coupling member 57 is moved downward along the vertically elongated hole 58 by repulsive force between the second magnet 57*a* and the third magnet 51*b* of like magnetic polarity, thereby being spaced apart from the first coupling member 51 by a separation distance therebetween equal to the length of the hole 58. As such, the end of the object can be released from the fixed position.

Referring to FIG. 6 in conjunction with FIG. 1, the end coupler 50 further includes a pressure ring 59 configured to be placed on the rotating shaft 30 to apply pressure to one side of the moving pressure member 53 when the rotating body 41 is placed on the rotating shaft 30.

The pressure ring 59 is configured to an open annular shape so as to be placed on or separated from the rotating shaft 30.

If the pressure ring 59 is placed on the rotating shaft 30, the pressure ring 59 comes into contact with one end of the moving pressure member 53, located in a direction in which the rotating body 41 is placed on the rotating shaft 30, and applies pressure to the moving pressure member 53 when the bobbin 40 is placed on the rotating shaft 30, thus causing the second coupling member 57 to be moved away from the first coupling member 51 of the end coupler 50. As such, as the end of the object caught between the first and second coupling members 51 and 57 is released, the object is able to be unwound from the bobbin 40 being rotated by the rotating shaft 30.

On the contrary, if the pressure ring 59 is removed from the rotating shaft 30, the moving pressure member 53 is not displaced even if the bobbin 40 is placed on the rotating shaft 30, thus causing the first and second coupling members 51 and 57 to be kept in contact with each other so as to keep the end of the object in a fixed position. Thereby, the object is able to be stably wound on the bobbin 40 during rotation of the bobbin 40.

As is apparent from the above description, the present invention provides a bobbin fixing apparatus having the following effects.

In the bobbin fixing apparatus of the present invention, a fixing unit is provided at a rotating shaft so as to be inserted into the rotating shaft upon receiving pressure. This allows an operator to conveniently secure a bobbin to the rotating shaft without operating a separate shaft fixing member.

The shaft fixing member is accommodated in a recess of the rotating shaft so as to be inserted into the rotating shaft when the bobbin is placed on the rotating shaft and then, be returned to an original position thereof by an elastic member, thereby acting to prevent unwanted separation of the bobbin from the rotating shaft. This ensures that a desired object can be wound on or unwound from the bobbin during stable rotation of the bobbin.

Further, in the present invention, a rotating body of the bobbin is provided with an end coupler to be operated upon receiving pressure. The end coupler can keep an end of the object in a fixed position during winding and release the end of the object from the fixed position during unwinding, thereby allowing the object to be wound on or unwound from the bobbin placed on the rotating shaft.

The end coupler of the present invention can keep the end of the object in a fixed position in a simplified manner using attractive force between first and second magnets of first and second coupling members of the end coupler in a state in which pressure is not applied to a moving pressure member of the end coupler.

If pressure is applied to the moving pressure member of the end coupler, the first and second coupling members are spaced apart from each other by repulsive force between the second magnet of the second coupling member and a third magnet of the first coupling member of like magnetic polarity, thereby allowing the end coupler to release the end of the object from the fixed position. In the present invention, the moving pressure member has a symmetrical configuration to allow the operator to apply pressure to one side or the other side of the moving pressure member, which allows the operator to conveniently place the bobbin on the rotating shaft without confirming a direction in which the bobbin is placed on the rotating shaft.

In addition, in the present invention, the first magnet is returned to an original position thereof if pressure applied to the first coupling member is removed, which ensures that the end of the object can be kept in a fixed position or be released from the fixed position in a simplified manner.

In particular, in the present invention, a pressure ring is placed on the rotating shaft to press the moving pressure member. By simply installing or removing the pressure ring to or from the rotating shaft as necessary, the moving pressure member can be pressed when the bobbin is placed on rotating shaft, which allows the end of the object to be kept in a fixed position or released from the fixed position without additional operation, resulting in enhanced operation convenience.

Finally, in the present invention, as the shaft fixing member on the rotating shaft is inserted into a fixing recess of the bobbin, it is possible to prevent independent rotation as well as separation between the bobbin and the rotating shaft, which can result in efficient winding or unwinding of the object.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A bobbin fixing apparatus comprising:

a mounting plate;

a rotating shaft installed to a front surface of the mounting plate and provided with a fixing unit partially protruding from the rotating shaft so as to be inserted into the rotating shaft; and a bobbin on or from which an object is wound or unwound, the bobbin being placed on the rotating shaft regardless of a direction in which the bobbin accesses the rotating shaft such that the fixing unit is exposed in front of the bobbin wherein the fixing unit includes:

a recess indented in a front circumferential position of the rotating shaft; and a shaft fixing member inserted in the recess so as to partially protrude from the rotating shaft, the shaft fixing member being completely inserted into the recess while pressing an elastic member provided therebelow upon receiving pressure applied when the bobbin is placed on the rotating shaft;

wherein the bobbin includes:

a rotating body consisting of a first rotating body and a second rotating body spaced apart from each other, the first and second rotating bodies respectively having shaft holes for insertion of the rotating shaft;

a plurality of bobbin members, on which the object is wound, each bobbin member having one end and the other end respectively connected to the first and second rotating bodies to guide insertion of the rotating shaft into the rotating body; and an end coupler having one end and the other end respectively connected to the first and second rotating bodies to guide insertion of the rotating shaft into the rotating body, the end coupler serving to keep an end of the object in a fixed position or release the end of the object from the fixed position upon receiving pressure applied when the rotating body is placed on the rotating shaft; and wherein the end coupler includes:

a first coupling member in which a moving pressure member centrally provided with a first magnet is installed, the moving pressure member being configured such that both ends thereof protrude outward from the first and second rotating bodies and being movable toward the first rotating body or the second rotating body; and a second coupling member spaced apart from the first coupling member and internally provided with a second magnet at a position corresponding to the first magnet both ends of the second coupling member being installed in vertically elongated holes of the first and second rotating bodies so as to be moved toward or away from the first coupling member.

2. The bobbin fixing apparatus according to claim 1, wherein a through-hole is perforated in the shaft fixing member to guide the shaft fixing member to be inserted into the recess and be installed within the rotating shaft, and a penetrating member is inserted in the through-hole such that both ends thereof are accommodated within the shaft fixing member.

3. The bobbin fixing apparatus according to claim 1, wherein the first magnet and the second magnet are oppositely charged magnets.

4. The bobbin fixing apparatus according to claim 1, wherein third magnets are provided at opposite sides of the first magnet such that a distance between the center of the first magnet and the center of either of the third magnets is equal to a moved distance of the moving pressure member when pressure is applied to the moving pressure member, the third magnets and the second magnet being magnets of like magnetic polarity.

5. The bobbin fixing apparatus according to claim 1, wherein a central portion of the moving pressure member has a greater outer diameter than an outer diameter of both end portions of the moving pressure member.

6. The bobbin fixing apparatus according to claim 5, wherein an elastic member is wound on either of the end portions of the moving pressure member to return the moving pressure member to an original position thereof when pressure applied to move the moving pressure member is removed.

7. The bobbin fixing apparatus according to claim 1, wherein the end coupler further includes a pressure ring separably placed on the rotating shaft to press one end of the movable pressure member when the rotating body is placed on the rotating shaft.

8. The bobbin fixing apparatus according to claim 1, wherein a fixing recess is formed in an outer surface of the bobbin such that one end of the shaft fixing member of the fixing unit is inserted into the fixing recess when the bobbin is placed on the rotating shaft.

* * * * *